United States Patent [19]

Colburn

[11] Patent Number: 4,587,870

[45] Date of Patent: May 13, 1986

[54] SKI BOOT BUCKLE TOOL

[76] Inventor: Kenneth Colburn, Box 184, RR #1, W. Main St., W. Cummington, Mass. 02148

[21] Appl. No.: 669,816

[22] Filed: Nov. 8, 1984

[51] Int. Cl.[4] ..... A63C 11/00

[52] U.S. Cl. ..... 81/15.9; 24/70 SK; 280/809; 254/131

[58] Field of Search ..... 81/15.9, 488; 280/809; 24/69 SK, 70 SK, 71.3; 254/131

[56] References Cited

U.S. PATENT DOCUMENTS 3,864,769 2/1975 Hamilton ..... 7/169

3,902,226 9/1975 Messenbaugh ..... 24/70 SK 4,250,595 2/1981 Byrnes ..... 24/71.3

4,304,019 12/1981 Sava ..... 254/131

*Primary Examiner*—Roscoe V. Parker

[57] ABSTRACT

A tool for use in opening and closing the buckle of a boot such as a ski boot. The tool consists of a handle member and engagement member set at an angle to the handle. The opening in the engagement member fits over the tongue or clamp of the buckle and permits the user to apply greater leverage to the clamp making it easier to open or close the buckle.

1 Claim, 6 Drawing Figures

SKI BOOT BUCKLE TOOL

BACKGROUND OF THE INVENTION

This invention relates to a small hand tool used to assist in opening and closing the buckle assembly of boots such as ski boots. One of the typical buckle assemblies consists of a wire loop pivotably mounted on the flap on one side of the opening in a boot and a tongue-like clamping member pivotably mounted on the flap on the other side of the boot opening. The bottom face of the clamping member is provided with a series of notches along its length which serve to selectively engage the wire loop. When the clamping member is pivoted into its closed position the two flaps are drawn toward each other under tension and the boot is tightened about the foot. In general, each boot has a plurality of such buckle assemblies.

Another buckle assembly similarly uses a slightly curved clamping member pivotably mounted on one of the flaps of the boot opening. Attached to the opposite flap is an eye-bolt provided with an adjustment nut. The clamping member is linked to the eye-bolt by means of a hook member. Tension adjustment is provided through the adjustment nut rather than by selection of one of the notches on the clamping member of the other type of buckle.

Skiers, or such, often experience difficulty in opening or closing a buckle in the cold, particularly on the slopes, because of accumulation of ice or snow on the buckle assembly and because the plastics of which the boots are molded, stiffen and tend to contract in the cold, further tightening the buckle. The clamp members of the buckles, being relatively short, do not afford good leverage and are difficult to operate in the cold, particularly since the hands tend to be stiff.

PRIOR ART

Efforts have been made by other inventors to provide a tool to facilitate the opening and closing of a ski boot buckle. In general such tools serve as an extension of the clamping member to provide greater leverage.

U.S. Pat. No. 3,902,226 (Sept. 2, 1975) Messenbaugh, discloses a tool formed by bending a small rod or wire to provide a cross arm at one end, said arm being capable of engaging a notch in the clamping member of a buckle assembly. The tool is a straight in-line-unit with the cross arm as a longitudinal extension of the handle. This tool has the disadvantage that the person's hand, when the person is attempting to use the tool, bumps into the boot or the ground and frequently must be taken off of the tool before completing the opening or closing operation. The major problem occurs when the tool is used to open the buckle; once the buckle snaps open the tool becomes wedged between the buckle and the boot.

U.S. Pat. No. 4,250,595 (Feb. 17, 1981) Byrnes, discloses a hook-like tool for opening and closing ski boot buckles. This tool has limited use since the hook-like element can be used to engage the clamping member only at one end or the other of the member.

SUMMARY OF THE INVENTION

This invention relates to an improved hand tool used to assist in closing and opening boot buckles, having greater versatility than prior buckle tools. It consists of a handle member and an engagement member at one end thereof, said engagement member being set at an angle to the handle, the angle being less than 90°. The engagement member comprises a pin mounted on an off-center arm, and a heel member spaced from the pin leaving a suitable width opening into which the clamping member of the buckle can be loosely inserted. When the handle of the tool is moved a few degrees in the desired direction, the clamping member of the buckle becomes tightly grasped between the pin and heel of the engagement end of the tool, whether or not the clamping member is notched; the buckle is opened or closed by further movement of the handle. Therefore, my tool is useful in operating several kinds of clamping members.

DETAILED DESCRIPTION OF THE INVENTION

Figure 1:
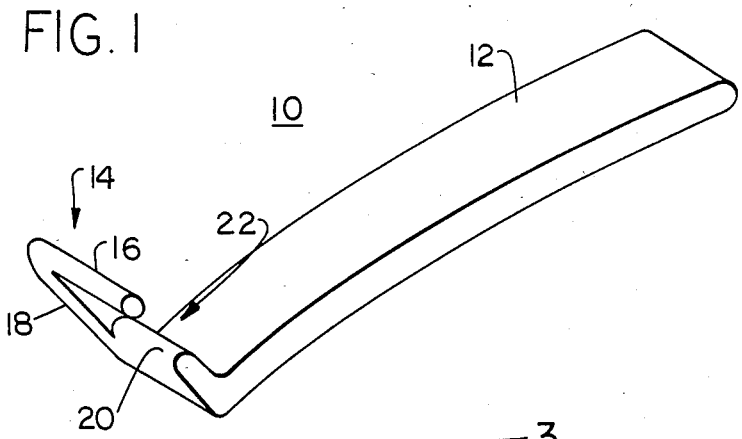
FIG. 1 is an isometric view showing my tool in perspective.

The invention will now be described with reference to the drawings. The tool is broadly indicated by 10, with handle member 12 and engagement member 14, as shown in FIG. 1. Engagement member 14 is integral with handle 12 and comprises pin 16 mounted on off-center arm 18 and heel member 20, said pin and heel being spaced apart to provide an opening 22 to receive the clamping member of the boot buckle assembly. Pin 16 preferably has a round cross-section suitable for engaging the notches of the clamping member of the buckle; however, the cross-section of the pin can be oval, square or other shape. Preferably the surface of pin 16 and of the heel 20 is grooved or otherwise provided with a rough texture to enhance their gripping action. The surface of heel 20 is shown as being rounded but can be another shape.

Figure 2:
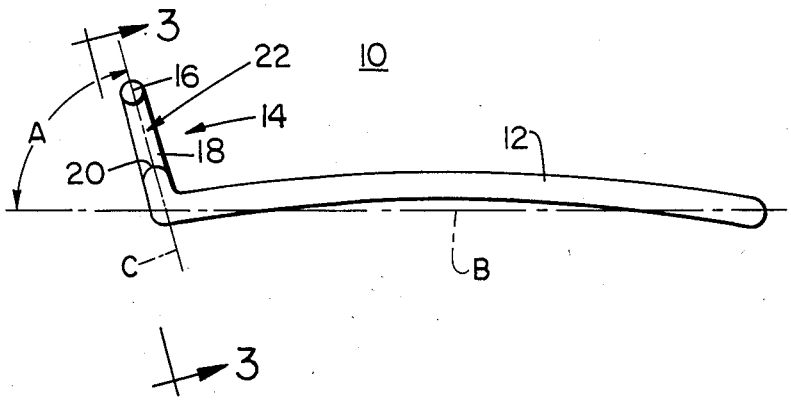
FIG. 2 is a side view of the tool.

Handle 12 can be straight or somewhat curved for a better grip; FIGS. 1 and 2 show a slightly curved handle.

The angle A between the handle member 12 and the engagement member 14 is shown in FIG. 2. Angle A is defined by lines B and C. Line B as shown in FIG. 2 is a line through the ends of handle 12; in effect line B is a chord in the arc of the circle defined by the curvature of handle member 12. Line C is a line through the center of pin 16 and the center of heel 20. I have found through testing that Angle A (exterior angle formed by lines B and C) should be less than 90° and in particular I have found that best results are obtained with an angle of about 75° plus or minus 5°. This angle permits a person opening or closing the buckle to do so with the tool held above the boot, and to operate the tool with good freedom without bumping the hand against the boot, the ground, the snow or other surface. The hand does not need to be removed from the tool and shifted to another position in order to complete the closing or opening of the buckle, as is often necessary with other boot buckle tools. These advantageous positions of operation when using my improved tool are illustrated in FIGS. 4, 5 and 6.

Figure 3:
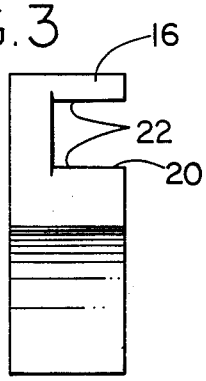
FIG. 3 is an end view of the engagement element of the tool.

FIG. 3 shows the opening 22 provided between pin 16 and heel member 20. This opening 22 must have a depth sufficient to permit the tool to be freely inserted on the clamping member 32, FIG. 4, from the side or over the top of member 32. In other words, the depth of the opening 22 must be such as to provide a loose fit with the clamping member 32 so as to permit ease of insertion of the tool. However, the depth of the opening 22 also must be limited such as to permit the pin 16 and heel member 20 to grip the clamping member 32 immediately after the start of the movement of the handle 12 to effect either the closing or opening of the buckle assembly. The gripping of the clamping member 32 between pin 16 and heel 20 is shown in FIGS. 4 and 5, and of clamping member 48 (without notches) is shown in FIG. 6. For conventional ski boots of the present, the depth of opening 22 typically is 7/16 inch.

Figure 4:
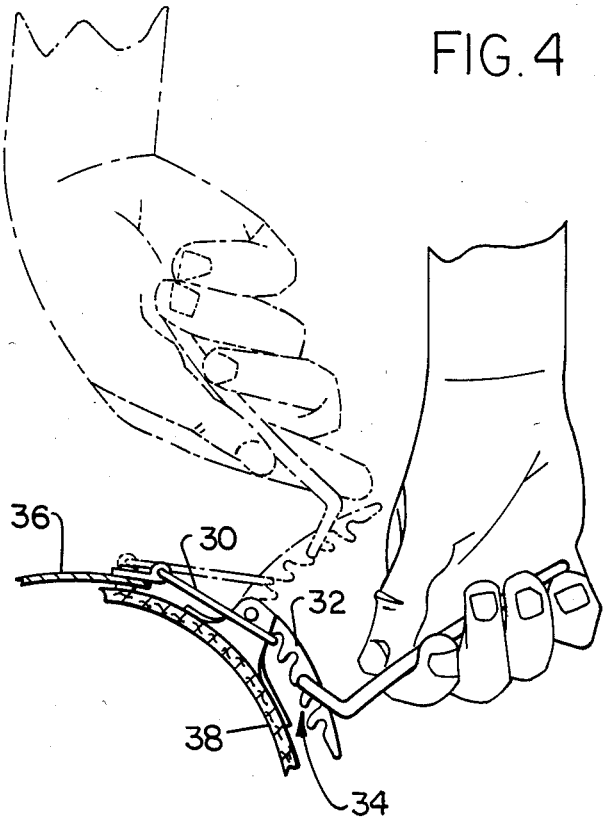
FIG. 4 is a partial cross-sectional view of a ski boot illustrating the use of the tool in closing a buckle.

FIG. 4 is a partial view of a cross-section of a boot opening illustrating how the tool of this invention is used with a buckle assembly. Wire loop 30 is pivotably fastened to one of the flaps 36 of the boot opening and is placed over clamping member 32 in one of the notches 34 as desired. Clamping member 34 is mounted on pivot 35 secured to flap 38. As handle 12 begins to be moved in the buckle closing operation, heel 20 and pin 16 apply pressure on opposite sides of clamping member 32 thereby gripping it firmly. As the movement of the handle continues the flaps 36 and 38 of the boot opening are drawn together to tighten the boot about the foot.

Figure 5:
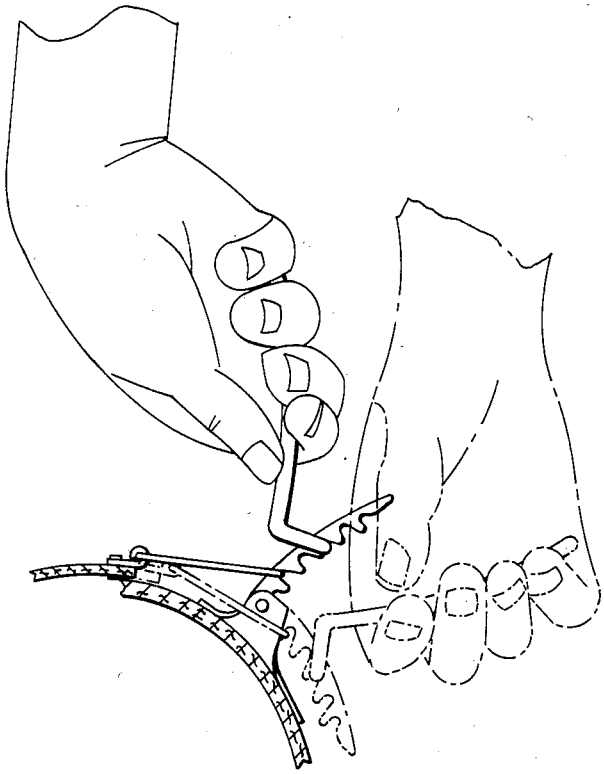
FIG. 5 is a partial cross-sectional view of a ski boot illustrating the use of the tool in opening a buckle.
Figure 6:
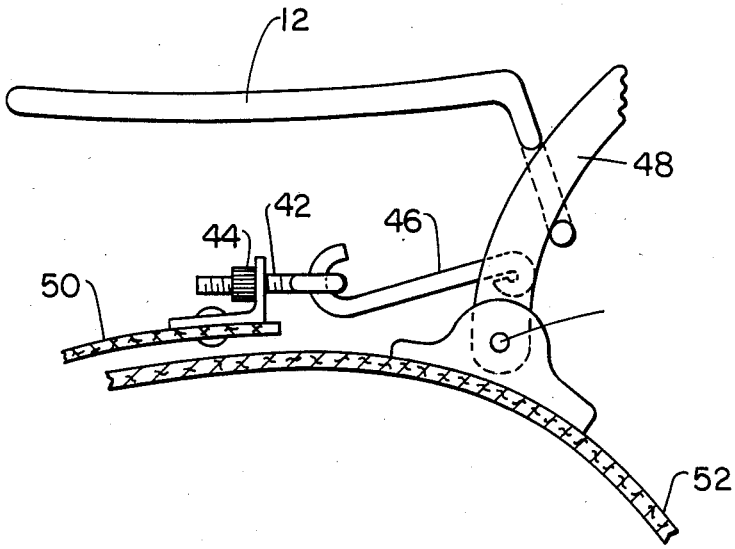
FIG. 6 is a partial cross-sectional view of a ski boot equiped with a different type of buckle, namely a buckle consisting of a clamping member, without notches, engaging an eye-bolt and adjusting nut unit.

FIG. 5 illustrates the use of tool 10 in opening a ski boot buckle assembly.

FIG. 6 illustrates another type of ski boot buckle assembly employing a clamping member 48 without notches. The adjustment in tension or spring force at the buckle is secured by means of the eye-bolt 42 and adjustment nut 44; the eye-bolt 42 is attached to flap 50 of the boot opening and is linked to clamping member 48 by means of hook 46.

Clamping members 32 and 48 usually are slightly curved to conform to the contour of the boots.

As illustrated in FIGS. 4, 5 and 6, when my tool is used to close or open a boot buckle, the handle is above the boot because of the specified angle between the handle and engagement member. This is a real advantage particularly when it is necessary to open or close a buckle assembly under adverse conditions, as on a ski slope. Also, my tool is versatile and can be used with various types of buckle assemblies.

While the use of my improved tool has been described in connection with ski boots, it is to be understood that the tool is suitable for use with other boots or the like employing similar types of buckle assemblies. In general such buckle assemblies consist of a clamping member and a second member which engages the clamping member in an adjustable manner. As is shown in FIG. 4, the wire loop is selectively inserted in one of the notches 34 to obtain the desired spring tension across the boot when the buckle is closed. In the version shown in FIG. 6 the spring tension across the boot is adjusted by means of adjustment nut 44.

I claim:

1. An improved tool for use in closing and opening a boot buckle assembly, said buckle assembly consisting of a pivotably mounted clamping member secured to one flap of an opening in a boot and a second member secured to the opposite flap of said opening in said boot, said second member being adjustably engagable with said clamping member, the improvement which comprises a handle member and an engagement member affixed to said handle member at an angle of about 75°, said engagement member comprising a pin mounted on an off-center arm and a heel member aligned with said pin and spaced from said pin to provide an opening which loosely receives said clamping member at any desired point along its length, said tool gripping said clamping member between said pin and said heel member as said handle of said tool is moved a few degrees in the desired direction to close or open said buckle assembly.

* * * * *